United States Patent [19]

Squires

[11] Patent Number: 5,061,832

[45] Date of Patent: Oct. 29, 1991

[54] FIELD SETTABLE DIFFERENTIAL PRESSURE SWITCH ASSEMBLY FOR LOW FLUID PRESSURE APPLICATIONS

[75] Inventor: Stephen L. Squires, LaPorte, Ind.

[73] Assignee: Dwyer Instruments, Inc., Michigan City, Ind.

[21] Appl. No.: 646,884

[22] Filed: Jan. 28, 1991

[51] Int. Cl.[5] ..... H01H 35/34

[52] U.S. Cl. ..... 200/83 J; 73/723; 200/82 C; 200/83 S; 200/83 V

[58] Field of Search ..... 73/717, 723, 745; 340/611, 626; 303/118; 200/51 R, 302.1, 302.2, 81.4, 81.5, 83 R, 83 J, 83 P, 83 V, 83 A, 83 S, 83 SA, 82 C

[56] References Cited

U.S. PATENT DOCUMENTS

| | | | |
|---|---|---|---|
| 3,007,017 | 10/1961 | Dwyer et al. | 200/83 |
| 3,566,060 | 2/1971 | Phillips et al. | 200/83 |
| 3,689,719 | 9/1972 | Phillips et al. | 200/83 P |
| 3,862,387 | 1/1975 | Phillips et ala. | 200/83 |
| 4,286,127 | 8/1981 | Quitoschinger | 200/83 S |
| 4,464,551 | 8/1984 | Johnson | 200/83 S |
| 4,540,860 | 9/1985 | Odashima | 200/83 P |
| 4,752,658 | 6/1988 | Mack | 200/83 P |
| 4,827,095 | 5/1989 | Clark et al. | 200/83 |
| 4,914,264 | 4/1990 | Everett | 200/83 S |
| 5,001,317 | 3/1991 | Atkinson | 200/83 P |

OTHER PUBLICATIONS

Tridelta Industries, Inc., Mentor, Ohio, Flyer (one sheet) entitled "Series 4000", distributed prior to 1990; (Photocopies of front & back of flyer provided).

Tridelta Industries, Inc., Mentor, Ohio, Flyer (one sheet) entitled "Series 5000", distributed prior to 1990; (Photocopies of front & back of flyer provided).

*Primary Examiner*—Gerald P. Tolin

*Attorney, Agent, or Firm*—Lee, Mann, Smith, McWilliams & Sweeney

[57] ABSTRACT

A differential pressure switch assembly for low pressure applications permitting accurate "in field" set pointing of same, comprising a capsulized instrument that includes housing high and low pressure sections defining in assembled relation a pressure cavity across which such sections mount a flexible diaphragm separating high and low pressure chambers, with the low pressure section mounting at a site on the low pressure section a snap switch unit of a size appropriate for such assembly, which unit has a projecting plunger therefor that has an end portion disposed in the low pressure chamber of the unit, with the assembly further comprising a pressure differential sensor disposed for effecting electrical switching of the snap switch unit when the pressure of the assembly high pressure chamber exceeds that of the low pressure chamber by a predetermined differential. The pressure sensor comprises a leaf spring that is initially flat between its ends and is mounted at one end of same to extend across the assembly low pressure chamber so that the other end of same cooperates with the switch unit plunger to effect said electrical switch of same, and such other end of the leaf spring includes an adjustment screw arrangement for acting on the snap switch unit plunger, to effect, prior to the assembly of the switch assembly, pretravel take up of the snap switch unit plunger in the range of from about sixty percent to about eighty percent.

10 Claims, 4 Drawing Sheets

FIELD SETTABLE DIFFERENTIAL PRESSURE SWITCH ASSEMBLY FOR LOW FLUID PRESSURE APPLICATIONS

This invention relates to differential pressure switch assemblies, and more particularly, to differential pressure switch assemblies that include one of the many commercially available snap switch units (known commercially as electrical snap switches) that are used in such assemblies for opening or closing the desired electrical circuit when the switch assembly pressure senses a predetermined condition requiring this.

It has long been common practice to control, for instance, the operation of air conditioning and other air flow cooling and heating systems, by way of an electrical system that includes a differential pressure switch assembly, that has high and low pressure chambers suitably connected to the high and low pressure sources normally involved and a snap switch unit of a size appropriate for such assembly and operated by the switch assembly to open or close the desired circuit when the differential pressure sensed by the switch assembly reaches a predetermined amount. In a particular commercially offered switch assembly of this type, the pressure sensing mechanism is a flexible diaphragm of a familiar type disposed in a housing that defines the high and low pressure chambers on either side of the diaphragm assembly, with the housing including suitable means to connect the respective pressure chambers to the respective sources of high and low pressure involved, and the deflection of the diaphragm resulting when the critical differential pressure is sensed being employed to operate the snap switch unit employed. In one important form of this type of device, the snap switch unit can be one of a number of makes of such units commercially available in the form of a relatively small housing having internal normally open and normally closed contacts, a so-called common terminal, and a plunger that has rectilinear movement in response to the assembly diaphragm deflection and operates the switch unit at its operating point to either open or close the electrical circuit involved. The commercially available snap switch units referred to are available in three different sizes, namely full size, miniature size, and subminiature size; switch assemblies which incorporate such switch units are to be basically sized and proportioned to the snap switch sizes that have been indicated.

While such differential pressure switch assemblies have also usually included some form of set point device to set the snap action switch unit to operate at what is supposed to be the switch assembly operating point, such instrument set point device all too often has been found unreliable, particularly where the switch assembly is to function at relatively low pressures.

The Applicant's studies of this problem in general, and his studies and analysis of the various snap action switch units commercially available, have revealed that the plunger of each of these snap switch units uniformly has two types of travel, namely a so-called differential travel, which is the travel of the plunger internally of the switch unit involved that is necessary to move the switch unit plunger to deactivate the switch unit after it has been activated, and pretravel, which is the movement of the switch unit plunger from its zero movement position to the position where the snap switch unit is activated (regardless of whether the switch unit is to open or close the desired electrical circuit).

The Applicant has found that, for differential pressure switch assemblies of the type indicated, and assuming that the triggering pressure differential is to deflect the snap switch unit plunger inwardly of the latter's housing to activate the switch unit, with take up of the snap switch unit plunger pretravel within a predetermined movement range (typically from about sixty per cent to about eighty per cent) prior to setting of the switch assembly at its so-called "set point", such set point may be reliably "in field" set, and especially for application to such switch assemblies in connection with situations where the triggering pressure differential is to be at a level on the order of 0.1–0.15 inch of water column pressure.

A principal object of the invention is to provide a differential pressure switch assembly of the type indicated where the switch assembly operating point may be reliably set, and "in field" after the switch assembly has been installed, for use in controlling the fluid flow for a given application.

Another principal object of the invention is to provide a differential pressure switch assembly of the type indicated that as part of the procedure of assembling the low pressure side of the switch assembly, a leaf spring, of the end to end "flat" type, is employed, and is cantilever mounted in operating position crosswise of the low pressure chamber for actuation of the snap switch unit plunger by its free end, and is adjusted to be disposed parallel to the neutral plane of the diaphragm of the assembly, whereby the leaf spring thus is disposed in its own neutral position, with the free end of the leaf spring that engages the snap switch unit plunger being provided with means for, when the leaf spring is in its said indicated neutral position, taking up pretravel of the plunger at least within the range indicated.

Yet another major object of the invention is to provide a differential pressure switch assembly that includes a set point screw for reliably setting the switch assembly at its switch operating point, free of inconsistencies that may be introduced by the tolerance of the leaf spring or variations in the plunger travel of the various makes of snap switch units that may be employed to actuate the switch assembly.

In accordance with the present invention, a differential pressure switch assembly for low pressure applications, for instance, where the pressure differential will be in the range of from about 0.1 to about 10.00 inches of water column, and that permits accurate "in field" set pointing, is provided, comprising a housing that includes a housing high and low pressure sections that are formed to define in assembled relation a pressure cavity across which such sections mount a flexible diaphragm separating high and low pressure chambers, with the low pressure chamber housing section mounting at a site on the housing low pressure section a snap switch unit selected from a number of such snap switches commercially available (that are of the size appropriate for the switch assembly in question, for instance the miniature size for miniature size switch assemblies), which type of snap switch unit has the indicated projecting activating plunger.

The snap action switch unit selected is mounted in the usual position on the pressure housing section at the site referred to, it thus being so located to dispose its plunger actuating end portion for exposure in the switch assembly low pressure chamber. The switch assembly low pressure housing section also mounts a fully flat leaf spring at one end of same that extends crosswise of the housing within what is to be the assembly low pressure chamber, with the other end of such leaf spring being disposed for effecting electrical switching of the snap switch unit. The low pressure housing section also includes means for effecting set pointing of the switch assembly, that is, setting of the electrical changeover point of differential pressure the switch assembly involved at the electrical changeover point of the snap switch unit, on travel of the snap switch unit plunger under the bias of the switch assembly diaphragm when the switch assembly involved is in use.

The leaf spring of the switch assembly also mounts adjacent its said other end, that is, its free end, an adjustment screw arrangement for acting on the snap switch unit plunger, after assembly of the switch assembly low pressure housing section, and before assembly of same to the switch assembly high pressure section, to effect preassembly pretravel take up in the range of from about sixty per cent to about eighty per cent; the means for effecting set pointing of the switch assembly is in the form of an adjustment screw threadedly mounted in the low pressure housing section and positioned to act on the leaf spring that may be "in field" operated to, in accordance of this invention, accurately set the switch assembly at its set point regardless of the make of the snap switch unit selected for assembly, and in spite of the tolerance variations that may be involved in specific leaf springs, to be employed, and the variations in operational forces of the various makes of snap switch units that one may select from, for use in fabricating the switch assembly.

Further in accordance with the invention, the low pressure housing section is integrally formed to define the site for the snap switch unit to be applied to the switch assembly, with the low pressure housing section also including mounting means whereby such snap action switch unit may be fully sealed off from the atmosphere and correctly located in place for accurate coaction of its plunger with the switch assembly leaf spring; further, the aforementioned set point screw is threadly mounted in the low pressure housing section for engagement with, and within the low pressure chamber, the leaf spring side that is opposite from that from which is directed the aforementioned leaf spring adjustment screw that is to engage the snap switch unit plunger, with the head of the set point screw being received in a well that is integral with and externally located on the assembly housing low pressure section, with the interior of the well and the head of the set point screw being formed to define a sliding seal relationship between the screw and the assembly low pressure housing section for effecting seal off of the housing low pressure section aperture that receives the set point screw.

The housing high and low pressure sections are also integrally formed to define the suitable tubular connections for respectively conducting the respective sources of high and low pressure to the respective housing sections; further, the housing high and low pressure sections are also integrally formed to define the suitable apertured lugs, or the like for securing such sections together and for mounting a switch assembly in place at the desired location on installation.

Assuming that the new differential pressure switch assembly of this invention is to be applied for controlling a fluid system involving a high pressure and a low pressure of which the differential pressure may increase to a critical point that is to effect actuation of the plunger of the snap switch unit involved, in an environment where the pressure differential is on the order of from about 0.1 inch to about 10.00 inches water column, the switch assembly may be first installed and then its set point screw actuated to set the switch assembly for actuating the snap switch unit thereof at such critical differential pressure, which will have the effect of, either opening or closing the desired electrical circuit (depending on the operational needs desired) which setting of the set point screw accurately sets the switch assembly itself.

Other objects, uses, and advantages will be obvious or be apparent from a consideration of the following detailed description and the application drawings in which like reference numerals indicate like parts throughout the several views.

Figure 2:
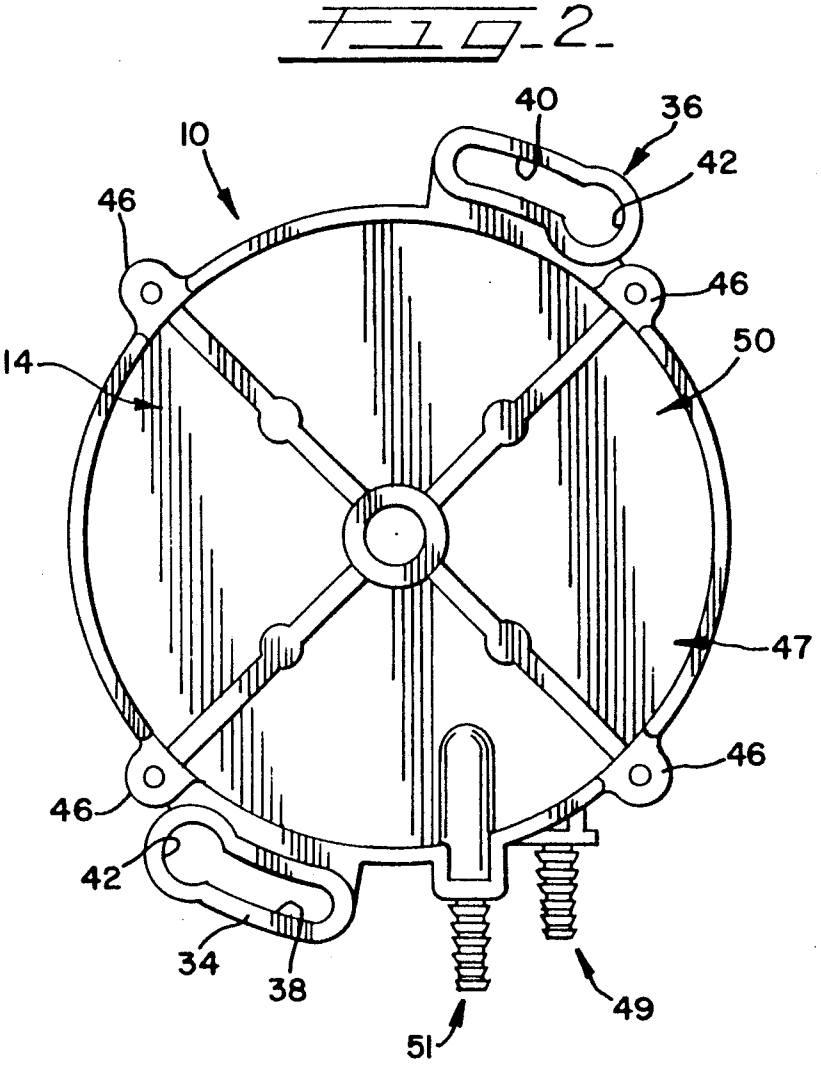
FIG. 2 is another plan view of the improved switch assembly, but taken from its high pressure side.
Figure 1:
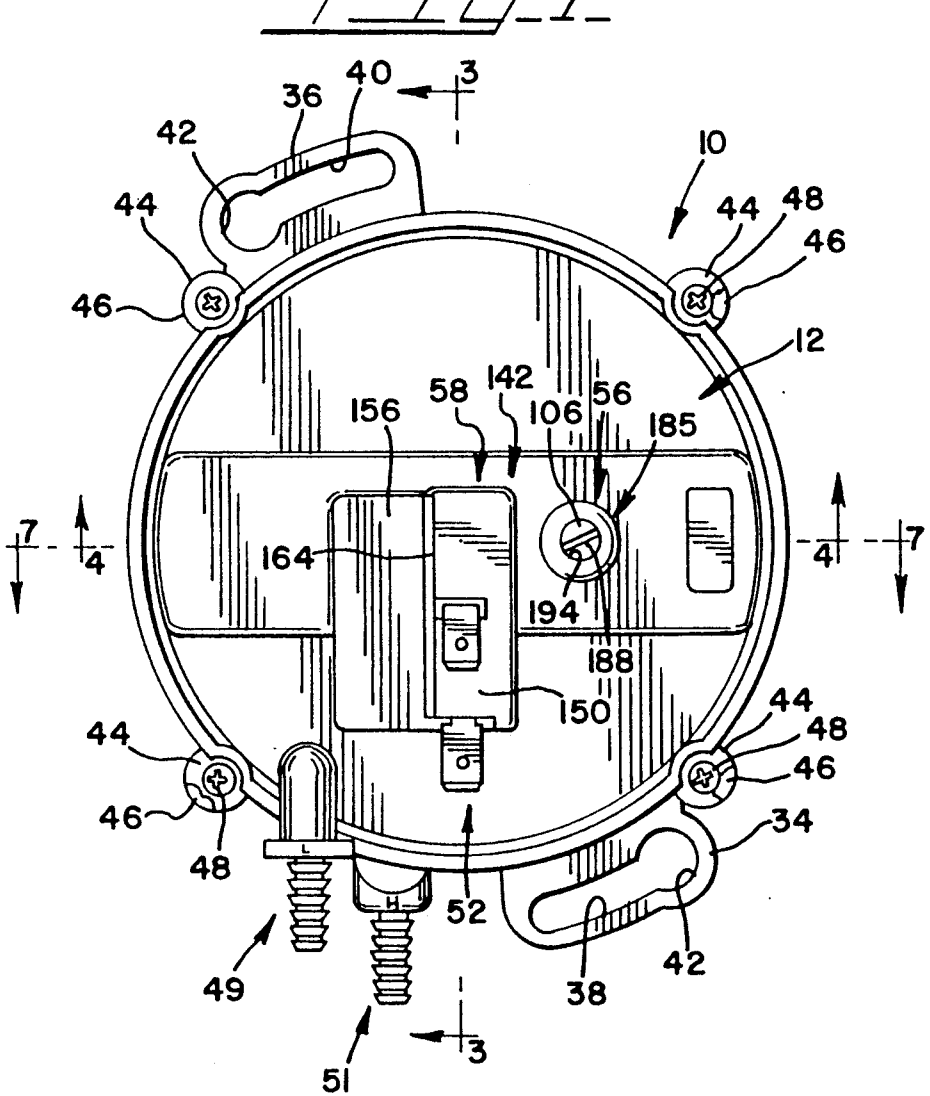
FIG. 1 is an exterior plan view of a switch assembly as improved by the present invention, taken from its low pressure side.
Figure 3:
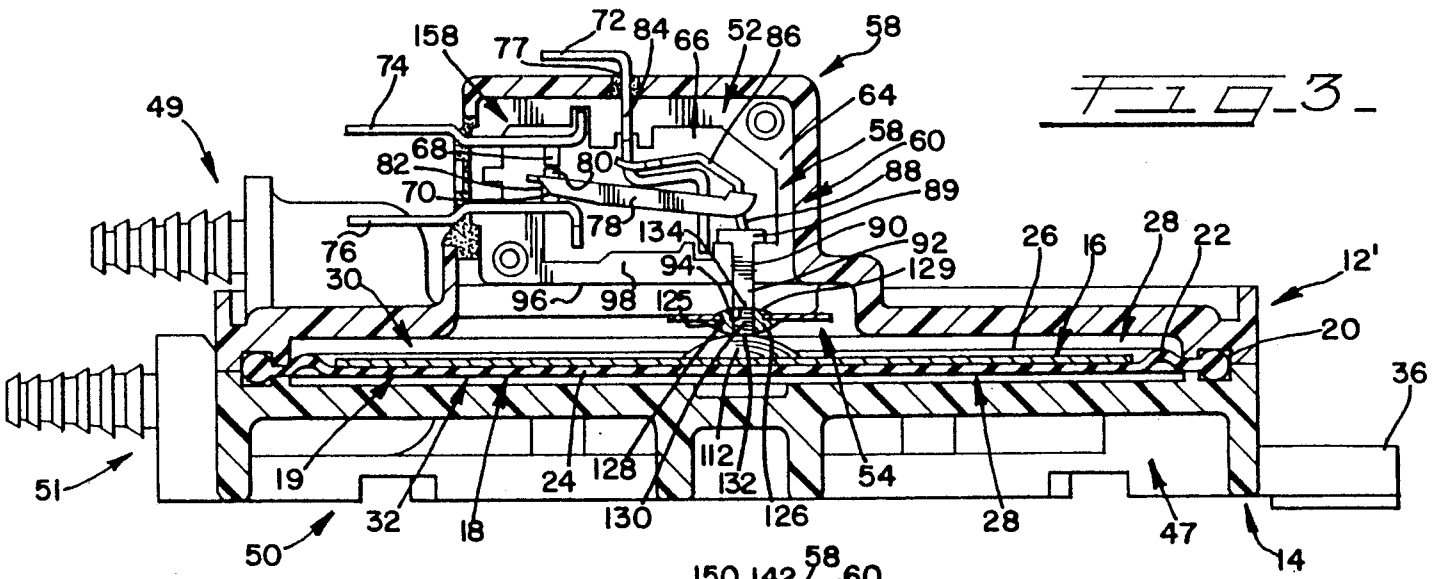
FIG. 3 is a sectional view through the improved switch assembly substantially along line 3—3 of FIG. 1, with a selected snap switch unit shown in its operative position on same, and showing diagrammatically the principal components of all commercially available makes of such snap switch units.
Figure 4:
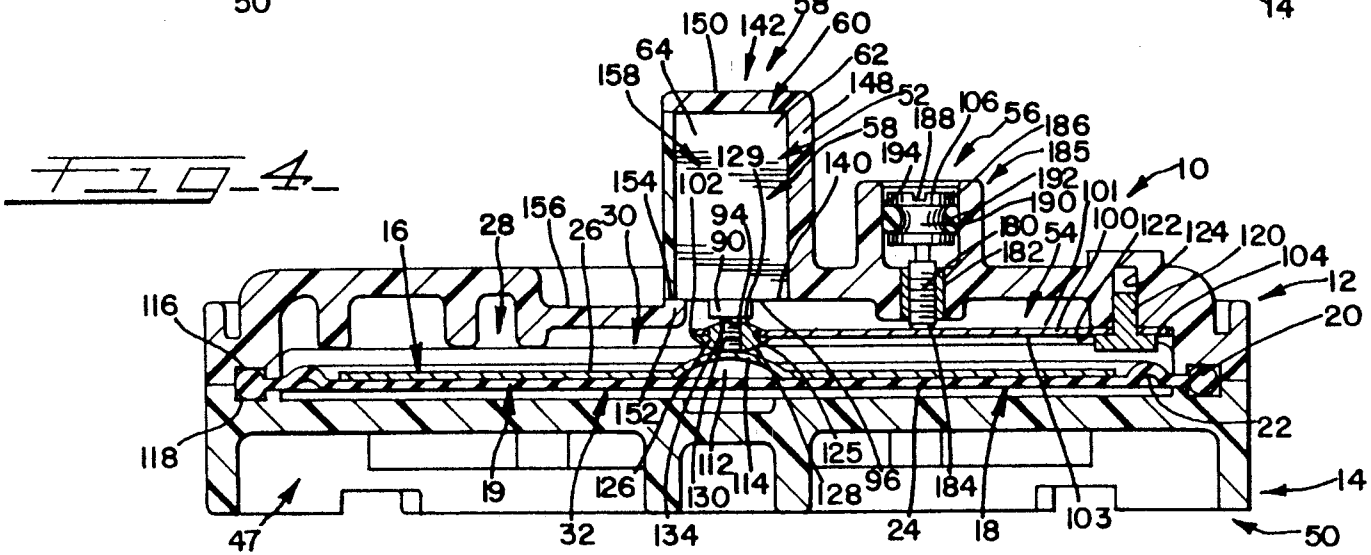
FIG. 4 is a sectional view of the improved snap switch assembly substantially along line 4—4 of FIG. 1, looking in the direction of the arrows, with the snap switch unit involved being shown in block diagram form.
Figure 5:
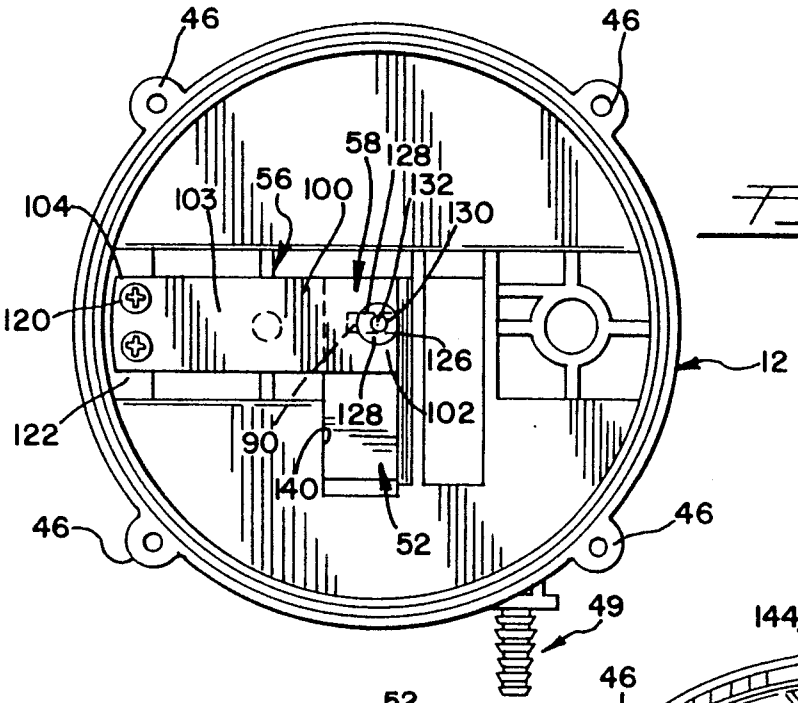
FIG. 5 is a plan view of the low pressure housing section of the improved switch assembly, as assembled, taken from the diaphragm side of same, but with the diaphragm omitted.
Figure 6:
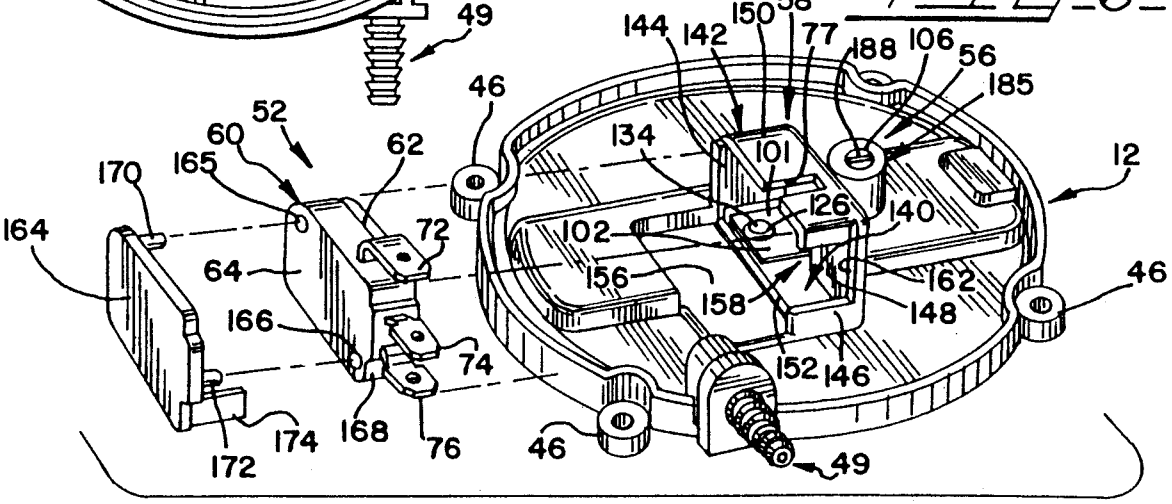
Figure 7:
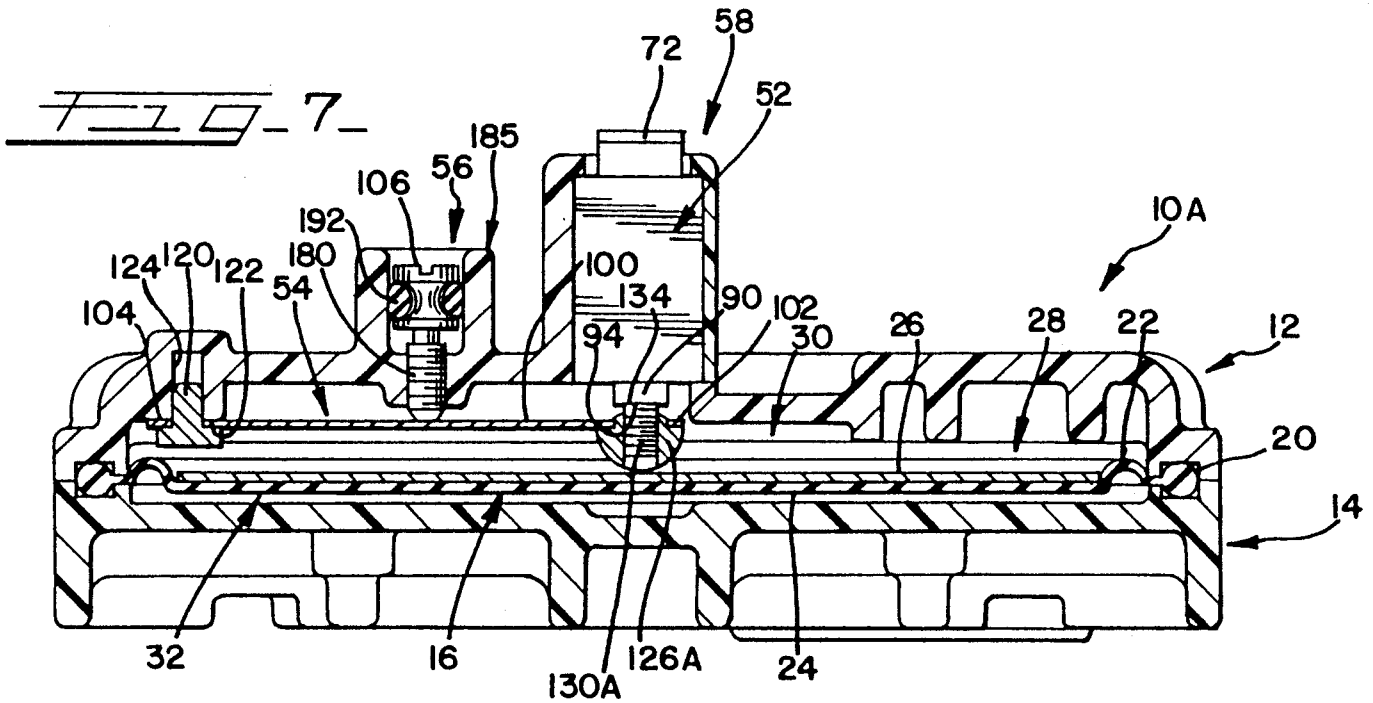

FIG. 6 is an exploded view of the exterior side of the improved switch assembly low pressure housing section, better illustrating the open side receptacle and closure panel therefor that are integral with the low pressure housing section, as well as the low pressure housing section aperture through which the snap switch unit plunger is to extend for cooperation with the assembly leaf spring, showing also the switch assembly leaf spring free end with its adjustment screw positioned as indicated in FIG. 3, and with the snap action switch unit and the closure panel for same shown in FIG. 4, being displaced to better illustrate the latter and the indexing arrangement involved in these two components for mounting an available make of snap switch unit that may be selected for incorporation in the illustrated switch assembly in the position shown in FIGS. 3 and 4; and FIG. 7 is a diagrammatic view, similar to that of FIG. 4, of a modified embodiment that is similar to that of FIGS. 1-6, but looking in the opposite direction, as indicated by the arrows of line 7—7 of FIG. 1, and with the snap switch unit involved being shown in block diagram form.

However, it is to be distinctly understood that the drawing illustrations referred to are provided primarily to comply with the disclosure requirements of the Patent Laws, and that the invention is susceptible of modifications and variations that will be obvious to those skilled in the art, and that are intended to be covered by the appended claims.

GENERAL DESCRIPTION

Referring first to FIGS. 1–4, there is illustrated one embodiment of the invention comprising a differential pressure switch 10 in capsulized form, with the drawings illustrating the switch 10 being enlarged to better show the component parts thereof. Furthermore, the switch 10 is proportioned to accommodate the miniature size conventional snap switch unit that is employed to open or close the desired electrical circuit with which the switch 10 is to be associated.

The capsulized switch unit 10 is basically diagrammatically illustrated, and comprises low pressure housing section 12 and high pressure housing section 14 that are clamped against a diaphragm unit 16.

The housing sections 12 and 14 are basically formed from a suitable plastic material that is non-electric in character, and that may be one of the Celanex 3310 and 3314 products offered by Hoechst Celanese Corporation, of Chatham, New Jersey, or the Valox No. 780 product offered by General Electric Company, of Pittsfield, Massachusetts. The housing sections 12 and 14 are respectively made in one piece form, by the practice of injection molding or the like, and are basically arranged in accordance with the present invention, as will be described as the disclosure proceeds.

The diaphragm assembly 16 is basically conventional in nature, and comprises a one piece generally circular diaphragm member 18 formed from a suitable elastomer, such as silicone rubber, to define an integral diaphragm body 19 comprising an outer circular rib 20 that forms the diaphragm rim, an annular flexing indentation 22, and an inner circular body 24 on which is provided the usual metallic, generally planar, diaphragm plate 26 that may be stamp-formed from aluminum or the like for the present application and anchored to the diaphragm body by the usual headed studding of the diaphragm projecting through similarly located apertures formed in plate 26 (not shown). As indicated in FIGS. 3 and 4, the housing sections 12 and 14 are clamped against the diaphragm unit rib 20, 360 degrees thereabout, for sealing purposes, with the diaphragm unit 16 being illustrated in its neutral position in FIGS. 3 and 4; the internal surfacings of the respective housing sections 12 and 14 defines a pressure cavity 28 within switch 10, across which the diaphragm unit 16 extends to further subdivide the pressure cavity 28 into a low pressure chamber 30 and a high pressure chamber 32.

The housing sections 12 and 14 in practice are clamped against the diaphragm rib 20 in any suitable manner, as, for instance in the illustrated embodiment, the high pressure housing section 14 is formed with a pair of oppositely located lugs 34 and 36 formed with arcuate slots 38 and 40, respectively, that are proportioned to respectively receive a suitable screw applied thereto at circular surfacing 42 thereof, as well as an appropriate mounting surface therefor that is not illustrated, so that the housing section 14 will be removably mounted, as is conventional. Both pairs of housing sections 12 and 14 are formed with the respective sets of four identically located integral eyelets 44 and 46 for suitable application thereto of the respective screws 48, as indicated in FIG. 1, for appropriately securing the housing sections 12 or 14 together against the diaphragm unit rib 20, whereby the entire switch assembly 10 can be removed from its mounting without disassembling the housing sections 12 and 14 if so desired. The housing sections 12 and 14 are formed with appropriate reinforcing ribbing and edging as needed for strengthening purposes, as will be apparent to those skilled in the art in view of the nature of the switch assembly 10. The shaping of the external side 47 of the high pressure housing section 14, which forms the underside 50 of assembly 10, may be such as to effect engagement of same with the mounting structure to which the switch assembly 10 is to be secured to in practice, as is well known to this art.

The low pressure housing section 12 is formed with a connector arrangement 49 for connecting the low pressure chamber 30 to the source of low pressure, while the high pressure housing section 14 is formed with tubular connector arrangement 51 for connecting the high pressure chamber 32 to the source of high pressure. As is conventional, suitable tubing is employed for this purpose, and connectors on the end of the tubing, if the arrangements 49 and 51 provide for screw threaded connections instead of the force fit connections that are illustrated.

Further employed in connection with devices of this type are a snap switch unit 52 that is one of a number of the makes of this type of unit commercially available, a pressure differential sensing device 54 (see FIGS. 3 and 4) for sensing the deflection of the diaphragm assembly 16 and transmitting same to the snap switch unit 52 that is operably associated with the switch assembly 10 for operation of the same to open or close the desired electrical circuiting involved, and a set point adjustment device 56 (see FIGS. 4 and 6) that is to permit setting of the switch assembly 10 to activate the snap switch unit 52 when the pressure differential sensed by the assembly 10 is a predetermined amount.

Unfortunately, conventional differential pressure switch assemblies of the type referred to have not heretofore permitted an accurate setting of the set point adjustment mechanism for accurate actuation of the snap switch unit when needed to accurately control the air and or flow arrangement controlled by the assembly 10 (either for shutting the fluid flow off or turning it on).

The major purposes of the present invention is to arrange differential pressure switch assemblies to provide the specifics illustrated for switch assembly 10 with regard to the devices 54 and 56, by arranging the switch assembly low pressure housing section and the components associated with same to permit, for instance, the snap switch unit 52 to be one of a number of commercially available devices of this type, and to provide the assembly 10 with other improvements, including the mounting of the snap switch unit 52 selected at a site 58 that accurately mounts same (regardless of the make of the unit 52 selected), and providing a device 54 and a mechanism 56 that are specially arranged in accordance with the present invention, and to utilize the mechanism 54 for making a fundamental adjustment in the snap switch unit 52 selected that permit switch assemblies of the type indicated at 10 in the drawings be employed to control a particular fluid flow arrangement with accurate set point setting of the assembly in a manner that heretofore has not been possible.

The Applicant's studies and investigations of differential pressure switch assemblies of the type indicated and the components comprising same has enabled him to provide switch mechanism 10 that is arranged in accordance with the showing of the appended drawings that permits accurate "in field" set pointing of the switch assembly 10 after the switch assembly 10 has been mounted to control the fluid flow involved in any particular system, and this accuracy is particularly evident at low pressure differentials on the order of 0.1 to 10.00 inches of water column.

For instance, the Applicant found that snap switch units 52 are made by the following U.S. companies:

1. Micro-Switch Division of Honeywell, Inc., Freeport, Illinois.
2. McGill Manufacturing Company, Inc., of Valporaiso, Indiana.
3. Cherry Electrical Products Corporation, of Waukegan, Illinois.
4. Burgess Switch Company, Inc. of Northbrook, Illinois.
5. Unimax, Inc., of Wallingford, Connecticut.

Other makes of this type of snap action switch unit are offered by smaller companies, principally from foreign countries such as Japan.

During the course of these studies and investigations, the Applicant found that snap switch units of this type are largely of all similar design, including the housing therefor that is generally parallelepiped in configuration, and that the switches come in three sizes, namely full size, miniature size, and subminiature size, depending upon the application required. While some makes of these snap switch units that are available have a force multiplying lever, this lever frequently can be used in accordance with the present invention, without removal, depending on the physical space available and the need for quick response.

FIG. 3 illustrates a typical arrangement of snap switch units of the type involved, which include the usual housing 60 made up of a removable side 62 and a main body 64 (see FIGS. 4 and 6) that is formed to define an internal chamber 66 for the operative components of the snap switch in which the latter are either mounted or extend. Reference numeral 68 (see FIG. 3) indicates the switch normally open contact, reference numeral 70 indicates the switch normally closed contact, and reference numeral 72 indicates the switch common terminal; the contacts 68 and 70 are respectively affixed for electrical connection to the respective prongs 74 and 76 that are plug fit received in the usual plug connected to the electrical conduit that leads to the source of supply of the electrical energy involved. Electrically connected with swing lever 78 are the contacts 80 and 82 that are disposed between the respective contacts 68 and 70, with the swing lever 78 normally being positioned so that its contact 82 is in electrical contact with the contact 70 of the prong 76, while there is a space between the contact 80 and the contact 68 that is secured to the prong 74 (meaning that contacts 68 and 80 are not in electrical contact). The common terminal 72 normally is in the form of an elongate strip 84 that enters the housing 10 at 77 and mounts a spring biasing member 86 that biases the swing lever 78 to the lower position shown in FIG. 3 (in which contacts 70 and 82 are in electrical energy transmitting engagement), with the spring biasing member 86 having an end portion 88 that bears against the head 89 of a plunger 90 (that has an end portion 92 extending outwardly of the snap switch unit cavity 66 and through housing floor 98) for being biased to the relation shown in FIG. 3. The function of plunger 90 is to accept the force that will swing the swing lever 78 to the position where its contact 82 is separated from contact 70 and its contact 80 is in contact with contact 68 (whereby the snap switch unit 52 either opens or closes the desired electrical circuit depending on how it is wired by the installer).

It will thus be seen that the plunger 90 of the switch unit 52 has a travel longitudinally thereof extending between a zero position defined by the end surface 94 (of the plunger end portion 92, when the plunger head 89 is biased against housing 60) and the position that such end surface 94 has at the end of one of the travels hereinafter defined.

Further study and investigation by the Applicant of the various makes of snap switch units referred to above has revealed that basically all such snap switch units have only two types of travel of the plunger 90 with respect to the housing 60 thereof, namely:

1. So-called differential travel, which is the travel of the snap switch unit plunger internally of the snap switch unit involved, namely its housing 60, that is necessary to deactivate the snap switch once the snap switch has been actuated, as by separating the contact 80 from the contact 68 after the switch unit has been operated to snap separate contacts 70 and 82 and bring into electrical engagement (with snap action) contacts 68 and 80; this travel of the plunger varies widely for the make of the snap switch unit involved, and the Applicant has found that this varies from about 0.002 inch to about 0.011 inch for the snap switch units mentioned above.

2. Travel of the snap switch unit plunger prior to, and up to, the activation of the switch unit that snap separates contacts 70 and 82 and brings contacts 68 and 80 (with snap action) into electrical engagement; this travel of plunger 90, which Applicant terms "pretravel" is illustrated by the movement of the snap switch unit plunger 90 from its zero position represented by the position of a plunger end surface 94 relative to the end surface 96 of the snap switch housing wall 98 (through which the plunger 90 extends in its fully retracted relation, see FIG. 3), to the point where the switch unit separates contacts 70 and 82 and brings contacts 68 and 80 into electrical engagement (with snap action); this distance also varies from about 0.0353 inch to about 0.0453 inch.

With these things in mind, the Applicant devised the illustrated switch assembly 10, in which the snap switch unit 52 is disposed at site 58 so that its plunger 90 is carried by the low pressure housing section 12 at site 58, and projects into the low pressure chamber 30, the pressure differential sensing device 54 employed is in the form of leaf spring 100 that is totally flat or planar between its ends 102 and 104 and is totally disposed in the low pressure chamber 30, with the end 104 being suitably secured to the low pressure housing section 12 and the end 102 of the leaf spring 100 being disposed underneath the end 94 of plunger 90 for take up of the pretravel of same a predetermined amount, and the switch assembly 10 is arranged and connected so that the diaphragm assembly 16 deflects under differential pressure so as to urge the leaf spring end 102 from its initial position of FIG. 4 to a position in the direction of the snap switch unit housing 60; further by having the set point adjustment mechanism 56 in the form of a set screw 106 threadedly mounted on the low pressure housing section 12 to engage the side 101 of the leaf spring 100 that is opposite that side 103 engaged by the diaphragm assembly 16, and by arranging for initial take up of the snap switch unit plunger 90 pretravel a significant amount, it appeared to me that an accurate "in field" set point setting of the switch assembly 10 was feasible.

SPECIFIC DESCRIPTION

Referring to FIGS. 3 and 4, the aforedescribed diaphragm assembly 16 is shown in its neutral position, within the switch assembly 10, in forming the low pressure chamber 30 and the high pressure chamber 32 out of pressure cavity 28. The diaphragm assembly 16 is round in plan configuration, and in the form illustrated in FIGS. 1–6, the plate 26 is stamped to define control button 112 having a spherically contoured head 114 to increase the spacing between the diaphragm 18 and leaf spring 100 (this assumes such space is available but see the embodiment of FIG. 7 where it is not). The diaphragm body 19 is preferably formed from silicone rubber, flurorosilicone, or Bune-N. As mentioned above, the diaphragm assembly 16 is clamped between the housing sections 12 and 14 to define the respective low and high pressure chambers 30 and 32.

The diaphragm assembly 16 being clamped between the housing sections 12 and 14 across the pressure cavity 28, the respective housing sections 12 and 14 are formed with the respective circular grooves 116 and 118 that are of continuous annular configuration and are proportioned to clamp against the annular diaphragm rib 20 for effective fluid sealing thereabout.

With regard to the pressure differential sensing device 54, as indicated this is to be in the form of leaf spring 100 defining the respective side surfaces 101 and 103 (see FIGS. 3 and 4) that is fully flat between its ends 102 and 104, and may be formed from suitable spring steel. At its end 104 the leaf spring 100 is apertured to receive a pair of screws 120 (see FIG. 5) that anchors the end 104 of the leaf spring 100 to the planar ledge surface 122 defined by the low pressure housing section 12. As indicated in FIG. 4, the screws 120 are preferably of the self threading type for application to the respective recesses 124 formed in the low pressure housing 12 for this purpose.

At the end 102 of the leaf spring 100 the leaf spring is apertured as at 125 for application thereto of an adjustment button 126 formed from a suitable plastic material (such as one of those materials suggested for housing sections 12 and 14), and defining opposed spherical end surfaces 128 and 129, which button 126 threadedly mounts set screw 130 having its end 132 suitably recessed or socketed to define a suitable non-circular recess for receiving a suitable turning tool, and its opposite end 134 disposed for thrusting action against the end surface 94 of the plunger 90 (see FIGS. 3 through 7), such as being in direct engagement therewith.

The low pressure housing section 12 in addition to the shaping already described, is, of course, internally configured to define the low pressure chamber 30 in relation to the diaphragm assembly 16, and also mounts the leaf spring 100 thereon for disposition in the low pressure chamber 30, in the indicated association with the plunger 90 of the snap switch unit 52 that has been selected from the various makes of same for incorporation in switch assembly 10. It is important that, in accordance with the present invention, and in addition to both the assembly 10 that is to be formed and the selected snap switch unit make thereby utilized being of similar sizing (as previously indicated), the snap switch unit make that is to serve as the snap switch unit 52 should be mounted so that any one of these snap switch units that are selected for use as the snap switch unit 52 be similarly positioned at site 58 so that the pressure differential signal provided by the diaphragm assembly 16 may be efficiently transmitted to the snap switch unit plunger 90 through the leaf spring button 126. For this purpose the low pressure housing section 12 is formed to define aperture 140 that is open to the low pressure chamber 30 in the assembled relation of the assembly 12; about the margin of the aperture 140 (shown to be of quadrilateral configuration in the illustrated drawings) the housing section 12 defines an upstanding box structure 142 (see FIG. 6) in the form of imperforate end wall 144, opposed slotted end wall 146, imperforate side wall 148, and slotted overhead wall 150 (see FIGS. 4 and 6). The side of the box structure 142 opposite imperforate side wall 148 is open, with the housing section 12 defining adjacent aperture 140, a short ledge 152 (see FIG. 4) defining a threshold surface 154 that is adjacent a housing section 12 external planar surface 156 that serves as a spot to initially seat the selected snap switch unit 52 on its base surface 96 for application to the chamber 158 of box structure 142, for purposes of mounting the selected snap switch unit 52 in the position indicated in FIGS. 3 through 5 over aperture 140. By positioning the indicated selected snap switch unit 52 on the surface 156, such snap switch unit may be then disposed on ledge surface 154 for shifting into the chamber 158, to the position indicated in FIGS. 3–5, the walls 146 and 150 being slotted as indicated at 162 and 77, respectively. Once the snap switch unit 52 is in the position indicated in FIGS. 3–5, so as to dispose the snap switch unit 52 such that its plunger 90 is in direct alignment with the leaf spring set screw 130, the panel 164 is fitted against the box structure 142 to in effect replace the box structure missing wall and thus oppose the imperforate box structure wall 148. The housing 60 of the snap switch unit of the type illustrated are typically formed with the respective recesses 165 and 166 (see FIG. 6) as well as slot 168, and those respectively to receive the respective studs 170 and 172, and the flange 174, that, in accordance with the present invention, are respectively provided on the panel 164, to in effect provide means for indexing and correctly locating the selected snap switch unit housing 60 in the box structure 142 relative to the leaf spring set screw 130. The panel 164 is suitably affixed to the box structure 142 in sealed relation therewith by applying a suitable epoxy material or the like therebetween (along all edges of the panel 164 as well as to its prongs 74 and 76 and terminal 72 at slot 77, such as shown in FIG. 3), so that while the chamber 158 defined by the box structure 142 is open to the low pressure chamber 30 (in the assembled relation of the switch assembly 10), the selected snap switch unit 52 is mounted in sealed relation within chamber 158 to separate same pressurewise from the atmosphere.

Further in accordance with the invention, the set point adjustment mechanism 56 comprises the aforementioned set screw 106 that includes a threaded shank portion 180 threadedly received in an internally threaded brass tubular member 182 suitably fixed to the low pressure section for disposing the end 184 to oppose the leaf spring 100; the tubular brass member 182 may be fixed in position in any suitable manner, as by being suitably bonded in place.

The low pressure housing section 12 also provides in circumambient relation about the set screw 106 a well 185 in which the set screw 106 is disposed, with the head 186 of the set screw 106 being formed to define a slot 188 to receive the flat blade portion of a suitable turning tool; the set point screw head 186 is also formed to define on the side surfacing of same a sealing groove 190 that extends 360 degrees thereabout for receiving the suitable annular O ring seal 192 in sealing reaction thereto and also to the internal wall surface 194 of the well 185 with which the seal 192 is in sliding relation thereto.

The connection arrangement 49 of the low pressure housing section 12 is basically conventional, and defines tubular recessing that connects the low pressure chamber 30 to the connection arrangement 49 and the tubing provided to the source of low pressure.

As to the high pressure housing section 14, the connection arrangement 51 is similar for communicating the high pressure chamber 32 to the source of high pressure.

The high pressure section 14 is otherwise basically conventional, its internal surfacing being appropriate for defining that part of the switch assembly pressure cavity 28.

Further in accordance with the invention, an assembly 10 is assembled generally as follows:

The low pressure housing section 12 is first assembled to include the leaf spring 100 and its components parts, the snap switch unit 52 that has been selected, and the set screw arrangement 56 that has been illustrated, in the manner that has been illustrated, and in any order that is convenient to the assembler.

However, an important factor in assembly of the low pressure housing section 12 is that the leaf spring 100 is to be disposed in parallel relation to the diaphragm unit 16 when the unit 16 is in its neutral position, which for practical purposes at this point in the assembly of switch assembly 10, is the illustrated coplanar relation to the plane of the housing section 12, before the set screw 130 is operated for pretravel take up of switch 52. For this purpose, the set point screw 106 may be suitably adjusted to achieve this positioning, if necessary, which positioning, moves the leaf spring 100 parallel to the neutral position of the diaphragm assembly 16 in the assembled relation of the switch assembly 10 as indicated. For this reason leaf spring 100 is to be flat or planar its entire length.

In any event, the internal side of the resulting assembled low pressure housing section 12 is shown in FIG. 5, and in this position, the recessed or socketed end 132 of set screw 130 is fully exposed. In accordance with this invention, a suitable turning tool is then applied to the end 132 of set screw 130 to take up the pretravel of the plunger 90 (of the snap switch unit 52 that is contained within the box structure 142), in what Applicant found to be the critical range of from about sixty to about eighty per cent, for conditioning of the assembly 10 for accurate "in field" set pointing.

The entire switch assembly 10 may then be assembled for sales and shipment, and when it has been mounted in place in connection with a particular fluid flow arrangement, the switch assembly 10 should be operated by (1) a positive pressure applied to the high pressure chamber 32, with the low pressure chamber exposed to atmosphere, (2) a negative pressure applied to the low pressure chamber with the high pressure chamber opened to atmosphere, or (3) by applying two separate positive pressures to the respective switch assembly high and low pressure chambers, with the higher pressure being connected to the high pressure chamber. The switch assembly 10 has been, in accordance with the present invention, previously conditioned for "in field" set pointing of same, which may be effected by rotating the set point screw 106 as needed to set the point of automatic operation of the snap switch unit 52 (that is mounted within the switch assembly 10), which thus becomes or establishes the actual set point operating action of the switch assembly 10, due to the adjustment that has been made.

The embodiment 10A of FIG. 7 is similar to that of FIGS. 1-6, except for several minor conventional features of the housing sections 12 and 14, and the lack of button 112; thus, the diaphragm assembly 16 acts directly on the leaf spring adjustment button 126A, which is enlarged for this purpose; set screw 130A is proportioned accordingly, it otherwise being the same as set screw 130. Also, set screw 106 is directly threadedly mounted in its housing section 12 in this embodiment.

It will be apparent from the foregoing that switch assemblies of the full size and subminiature size, with full size and subminiature size snap switch units 52, respectively, will be arranged in a manner similar to the disclosed miniature size assembly 10, and its miniature size snap switch unit 52, that is disclosed hereby.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a differential pressure switch assembly that comprises a capsule defining a pressure cavity across which is mounted a flexible diaphragm separating high and low pressure chambers, with the capsule including a housing that mounts a pressure differential transmitting device in the low pressure chamber and also mounts at a site on the low pressure side thereof a snap switch unit that includes a projecting plunger therefor which has an end portion positioned in the low pressure chamber in predetermined relation to the pressure differential transmittal device for engagement thereby for effecting electrical switch operation of the snap switch unit, when the pressure differential transmitted has increased sufficiently to cause the diaphragm to sufficiently deflect the transmittal device, and means for setting the assembly for effecting electrical switching of the snap switch on travel of the plunger under the bias of the diaphragm, with the housing including means for connecting the high pressure chamber to a source of high pressure, and means for connecting the low pressure chamber to a source of low pressure, the improvement wherein:

the transmitting device comprises a leaf spring, said leaf spring being essentially planar in configuration from one end to the other end thereof, with said leaf spring being mounted at its said one end thereof to be substantially parallel with the diaphragm in the neutral position of the diaphragm and to be disposed at its other end for engagement with the snap switch unit plunger end portion to effect pretravel thereof when biased by the diaphragm, and including:

adjustment screw means adjacent said other end of said leaf spring positioned to limit said pretravel of the snap switch unit plunger in the range of from about sixty to about eighty per cent of its pretravel, said setting means comprising a set point screw threadedly mounted in the housing of the low pressure chamber side of the housing for engaging the leaf spring intermediate said ends thereof, said set point screw being in fluid sealing relation to the housing.

2. The improvement set forth in claim 1, wherein:

said set point screw includes a shank in threaded engagement with the housing on the low pressure side thereof and a head including a face facing exteriorly of the housing, said head face of said set point screw being polygonally recessed to accept a similarly polygonal configured end portion of a turning tool.

3. The improvement set forth in claim 2, including:

a sliding fluid seal interposed between said set point screw head and said housing to provide said fluid sealing relation of said set point screw to said housing.

4. The improvement set forth in claim 3, wherein:

said sliding fluid seal comprises:

said housing defining a well having an annular internal sealing surface in which said set point screw is centered, and including an annular seal interposed between said set point screw head and said well sealing surface, said seal being keyed to said set screw head for movement therewith and in sliding relation to said well sealing surface.

5. The improvement set forth in claim 1, wherein:

the site is integrally defined by said housing and is on the low chamber side thereof and comprises:

a box proportioned to receive the snap switch unit at the site with the plunger thereof disposed to be directed toward said other end of the leaf spring and having one side of said box open to slip fit receive the snap switch unit therein, a panel fixed to said box for closing same for enclosing in same the snap switch unit, and means for fluid sealing said snap switch unit within said box, said panel and said snap switch unit including indexing means for predetermined position mounting of the snap switch unit within said box for effecting said predetermined relation of the snap switch unit plunger end portion with said leaf spring.

6. In a low pressure differential pressure switch assembly that includes first and second discrete housing members clamped together in side by side relation and formed to define a pressure cavity across which is mounted a flexible diaphragm that sealingly separates within the cavity high and low pressure chambers, with the first housing member being on the low pressure side of the switch assembly and the second housing member being on the high pressure side of the switch assembly, with the first housing member including means for connecting the low pressure chamber to a source of low pressure, and the second housing member including means for connecting the high pressure chamber to a source of high pressure, and with the first housing member mounting both a snap switch unit and a pressure differential transmitting device, with the snap switch unit being located at a specific site on the first housing member and having its actuating plunger oriented to dispose the actuating end thereof in the low pressure chamber, and the pressure differential transmitting device being disposed within the low pressure chamber and being interposed between the diaphragm and the snap switch unit plunger actuating end for actuation of the snap switch unit when the pressure differential transmitted has built up to a predetermined value, and means for setting the assembly for effecting electrical switching of the snap switch unit on travel of the snap switch unit plunger under the bias of the diaphragm, the improvement, for operating the switch assembly at fluid pressures in the range of from about 0.1 inch to about 10.00 inches of water column pressure, wherein:

the transmitting device comprises a leaf spring cantilever mounted adjacent one end thereof and having the other end thereof cooperating between the diaphragm and the snap switch unit plunger actuating end, said leaf spring being essentially planar in configuration from end to end, and as mounted and as disposed in its neutral position, being in substantial parallelism with the diaphragm when the latter is in its neutral relation, and including:

adjustment screw means adjacent said other end of said leaf spring directed at the snap switch unit plunger actuating end for take up of the snap switch unit plunger pretravel in the range of from about sixty per cent to about eighty per cent, said setting means comprising a set point screw threadedly mounted in the first housing member for engaging said leaf spring intermediate said ends thereof on the side of said leaf spring facing the snap switch plunger, said set point screw being in fluid sealing relation to the first housing member.

7. The improvement set forth in claim 7 wherein:

said set point screw includes a shank in threaded engagement with the first housing member, and a head including a face facing exteriorly of the housing, said head face being polygonally recessed to accept a similarly configured end portion of a turning tool.

8. The improvement set forth in claim 7, including:

a sliding fluid seal interposed between said set point screw head and the first housing member to provide said fluid sealing relation of said set point screw to said first housing member.

9. The improvement set forth in claim 8, wherein:

said sliding fluid seal comprises:

said first housing defining a well having an annular sealing surface in which said set point screw is centered, and including an annular seal interposed between said set point screw head and said well sealing surface, said seal being keyed to said set point screw head for movement therewith and being in sliding relation to said well sealing surface.

10. The improvement set forth in claim 6, wherein:

the site is integrally defined by said first housing member and comprises:

a box proportioned to receive the snap switch unit at the site with the plunger thereof disposed to be directed toward said other end thereof and having one side of said box open to slip fit receive the snap switch unit therein, and a panel fixed to said box for closing same for enclosing in same the snap switch unit, said panel of said snap switch unit including indexing means for predetermined position mounting of the snap switch unit within said box for effecting said predetermined relation of the snap switch unit plunger end portion with the lead spring, and including means for fluid sealing of said snap switch unit within said box.

* * * * *